US006754981B1

(12) United States Patent
Edwards

(10) Patent No.: US 6,754,981 B1
(45) Date of Patent: Jun. 29, 2004

(54) FOOTWEAR STRUCTURE WITH OUTSOLE BULGES AND MIDSOLE BLADDER

(75) Inventor: Harry W. Edwards, Barrington, IL (US)

(73) Assignee: Energaire Corporation, Cheyenne, WY (US)

( * ) Notice: Subject to any disclaimer, the term of this patent is extended or adjusted under 35 U.S.C. 154(b) by 49 days.

(21) Appl. No.: 10/150,467

(22) Filed: May 20, 2002

(51) Int. Cl.[7] ..... A43B 13/18; A43B 13/20

(52) U.S. Cl. ..... 36/29; 36/3 R; 36/35 R; 36/37

(58) Field of Search ..... 36/28, 29, 3 R, 36/3 A, 3 B, 35 R, 37, 35 B

(56) References Cited

U.S. PATENT DOCUMENTS

| | | | | |
|---|---|---|---|---|
| 2,605,560 A | | 8/1952 | Gouabault | |
| 4,547,978 A | | 10/1985 | Radford | |
| 4,887,367 A | | 12/1989 | Mackness et al. | |
| 5,406,719 A | | 4/1995 | Potter | |
| 5,416,986 A | | 5/1995 | Cole et al. | |
| 5,524,364 A | * | 6/1996 | Cole et al. | 36/29 |
| 5,664,341 A | | 9/1997 | Schmidt et al. | |
| 5,701,687 A | | 12/1997 | Schmidt et al. | |
| 5,718,063 A | | 2/1998 | Yamashita et al. | |
| 5,771,606 A | * | 6/1998 | Litchfield et al. | 36/29 |
| 5,794,359 A | | 8/1998 | Jenkins et al. | |
| 5,842,291 A | | 12/1998 | Schmidt et al. | |
| 5,893,219 A | * | 4/1999 | Smith et al. | 36/3 B |
| 5,901,467 A | | 5/1999 | Peterson et al. | |
| 5,956,869 A | * | 9/1999 | Kim | 36/29 |
| 6,055,746 A | | 5/2000 | Lyden et al. | |
| 6,092,309 A | | 7/2000 | Edwards | |
| 6,158,149 A | | 12/2000 | Rudy | |
| 6,199,302 B1 | | 3/2001 | Kayano | |
| 6,253,466 B1 | | 7/2001 | Harmon-Weiss et al. | |
| 6,266,897 B1 | | 7/2001 | Seydel et al. | |
| 6,266,898 B1 | | 7/2001 | Cheng | |

FOREIGN PATENT DOCUMENTS

| | | |
|---|---|---|
| GB | 2073006 | 11/1980 |
| GB | 2150010 | 9/1984 |

* cited by examiner

*Primary Examiner*—Marie Patterson
(74) *Attorney, Agent, or Firm*—Seyfarth Shaw LLP

(57) ABSTRACT

A footwear structure includes an outsole having outwardly projecting heel and metatarsal bulges joined by a resticted channel, the bulges and channel all opening at an interior surface of the outsole. A flexible bladder is disposed against the interior surface of the outsole and has a generally horseshoe-shaped pocket straddling the heel cavity of the outsole and a pair of matatarsal pockets respective disposed upon opposite lateral sides of the metatarsal cavity of the outsole, the ends of the bladder heel pocket being respectively joined to the metatarsal pockets by restricted passageways to from a closed fluid-containing system. The bladder pockets are respectively accommodated in recesses in an inner surface of a midsole which is secured to the interior surface of the outsole for closing the outsole cavities and restricted channel to form another closed fluid-containing system.

20 Claims, 6 Drawing Sheets

FOOTWEAR STRUCTURE WITH OUTSOLE BULGES AND MIDSOLE BLADDER

BACKGROUND

This application relates to footwear and, in particular, to sole and heel structures for shoes, boots or the like. The application relates in particular to footwear structures incorporating fluid-filled cavities for providing cushioning, forward thrust and the like.

Various types of footwear structures having fluid-containing cavities or systems have heretofore been provided. Some of the structures have included a molded outsole with cavity-defining bulges therein which are closed by an overlying midsole, communication between the bulges being provided through narrow, restricted channels or passageways to accommodate movement of fluid back and forth between the cavities. Other structures have incorporated closed, flexible bladders with expandable fluid-filled pockets, which may also be interconnected by narrow restricted passageways. In some prior structures, the pockets of such bladders have been accommodated in cavities in an outsole and/or a midsole. All of these prior arrangements have incorporated, essentially, only a single closed fluid-containing system.

SUMMARY

There is disclosed in this application a footwear structure which avoids the disadvantages of prior structures while affording additional structural and operating advantages.

An aspect is the provision of footwear structure which is characterized by improved cushioning and lateral stability, while affording shock absorption and forward thrust.

An important aspect is the provision of a footwear structure which includes two separate fluid-containing systems.

Another aspect is the provision of a footwear structure of the type set forth, wherein the fluid-containing systems are disposed within a structure including an outsole, a midsole and a flexible bladder.

Another aspect is the provision of a footwear structure of the type set forth, wherein at least one of the outsole and the midsole includes cavities for accommodating bladder pockets.

A still further aspect is the provision of a footwear structure of the type set forth, in which each of the fluid-containing systems includes cavities or pockets which are disposed outside the cavities or pockets of the other system.

Another aspect is the provision of a method of forming a footwear structure of the type set forth.

BRIEF DESCRIPTION OF THE DRAWINGS

For the purpose of facilitating an understanding of the subject matter sought to be protected, there is illustrated in the accompanying drawings an embodiment thereof, from an inspection of which, when considered in connection with the following description, the subject matter sought to be protected, its construction and operation, and many of its advantages should be readily understood and appreciated.

DETAILED DESCRIPTION

Figure 2:
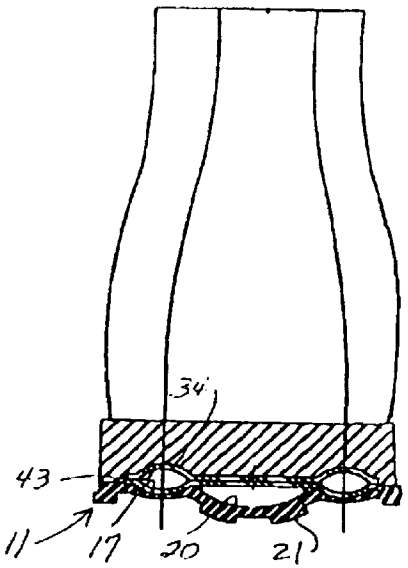
FIG. 2 is a view taken generally along line 2—2 in FIG. 1.
Figure 1:
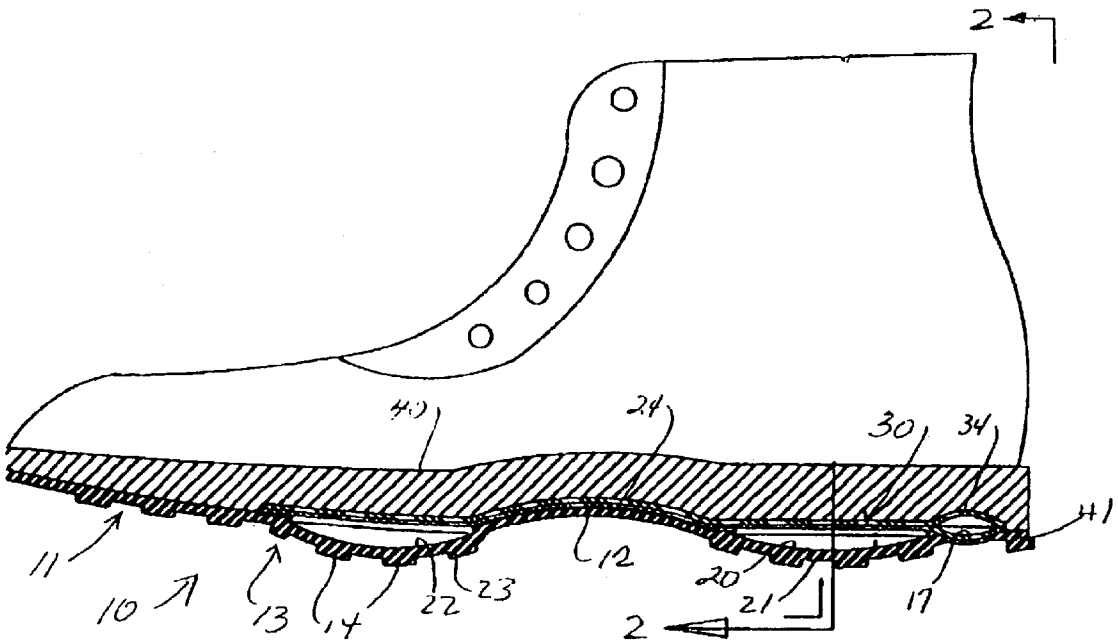
FIG. 1 is a side elevational view of footwear structure in a boot in partial longitudinal vertical section.

Referring to FIGS. 1 and 2, there is illustrated a boot including footwear structure in the nature of a sole and heel construction, generally designated by the numeral 10, which includes an outsole 11, a bladder 30 and a midsole 40. While shown in a boot, such as a work boot, the structure 10 is designed to be used in the construction of other footwear, such as other types of boots, shoes or the like, which would include appropriate additional structure, such as an upper, insole, sock liner and the like.

Referring also to FIGS. 3–6, the outsole 11 is of one-piece molded construction, preferably formed of a flexible, highly wear-resistant material, the material used depending upon the specific type of shoe or boot in which the outsole 11 is to be used. The outsole 11 has an exterior, or ground-contacting surface 12 provided with a tread pattern 13 which, in the illustrated embodiment, includes a plurality of projecting lugs 14. The tread 13 is designed for use on a work boot, but it will be appreciated that other types of tread designs could be utilized, depending upon the particular type of footwear in which the outsole 11 is used. The outsole 11 also has an interior surface 15 (FIG. 4) which may have formed therein a very shallow recess 16, generally in the shape of the outline of the bladder 30, to aid in accurately positioning the bladder on the outsole 11, as will be explained more fully below. Formed in the recess 16 may be additional shallow recesses 17, 18 and 19 for specific pockets of the bladder 30. The recesses 16–19 facilitate positioning of the bladder.

Figure 3:
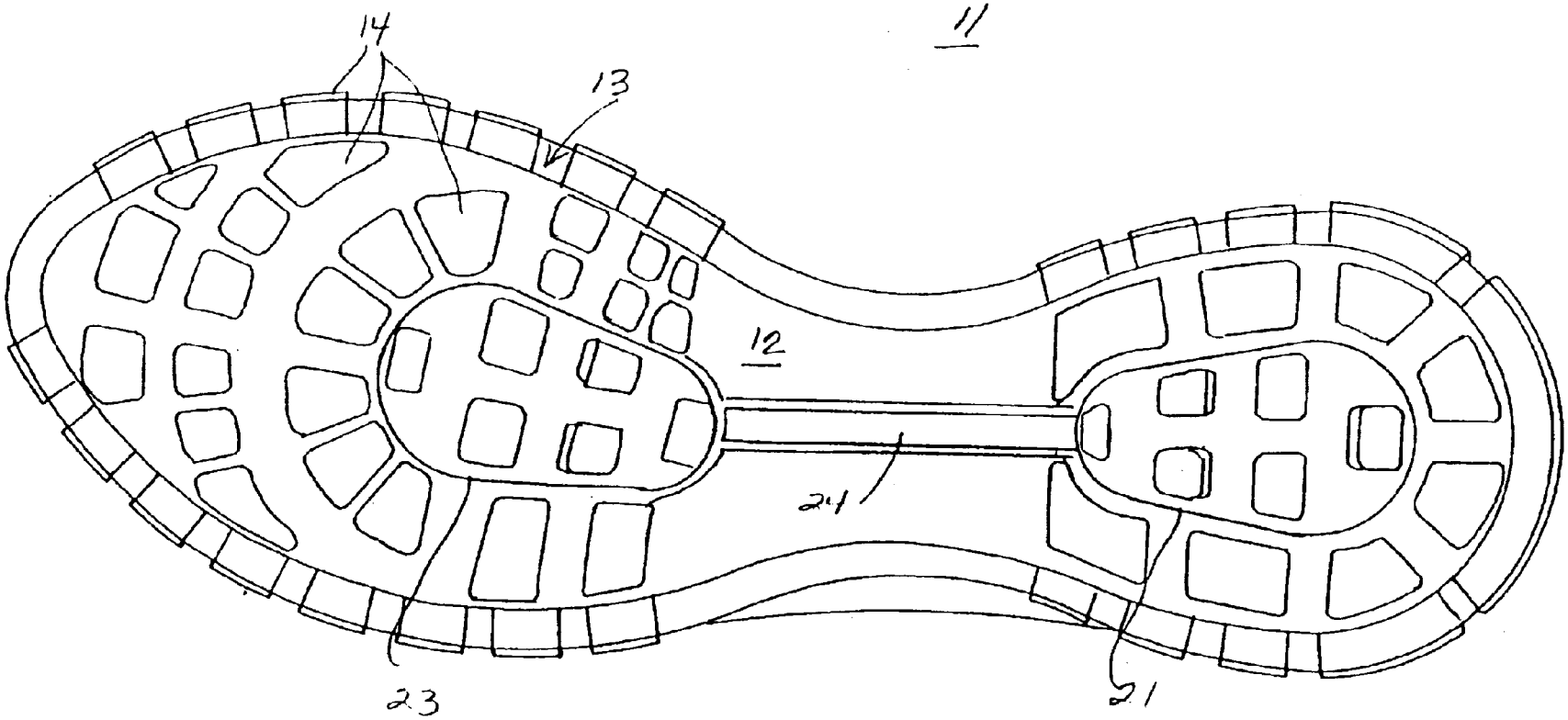
FIG. 3 is a bottom plan view of the outsole of the footwear structure of FIG. 1.
Figure 4:
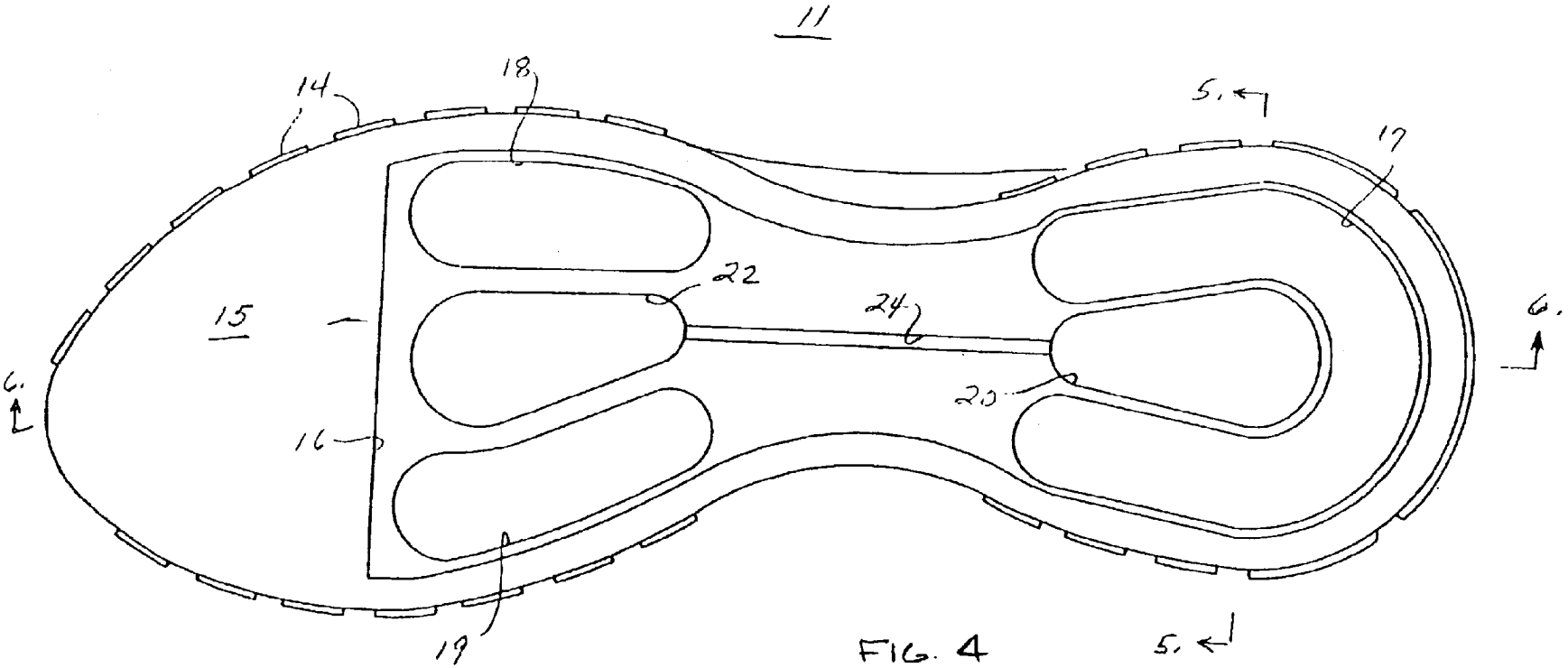
FIG. 4 is a top plan view of the outsole of FIG. 3.
Figure 5:
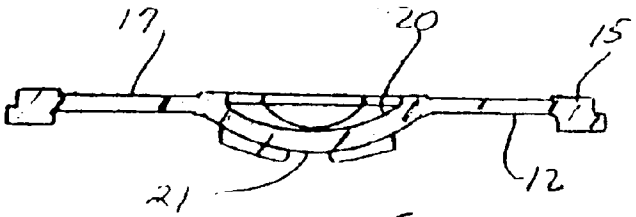
FIG. 5 is a sectional view taken generally along the line 5—5 in FIG.
Figure 6:
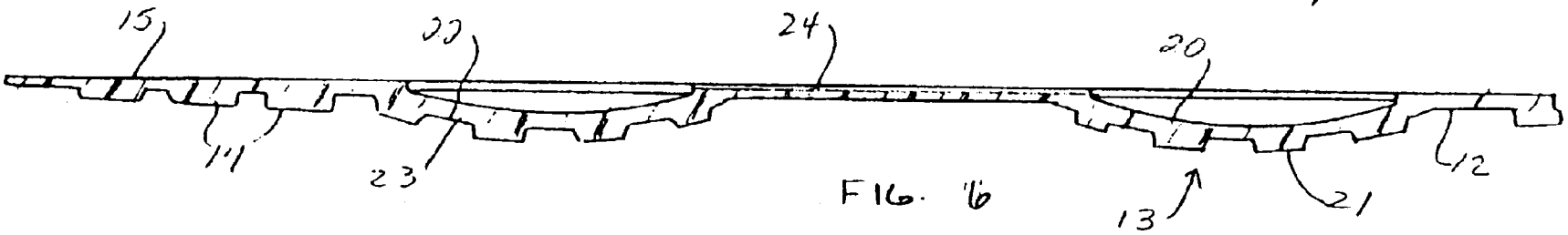
FIG. 6 is a sectional view taken generally along the line 6—6 in FIG. 4.

Also formed in the interior surface 15, in the heel region of the outsole 11, is a generally teardrop-shaped cavity 20 which defines a bulge 21 which projects outwardly of the outer surface 12 of the outsole 11, as can been see in FIG. 3. Also formed in the interior surface 15, in the metatarsal region of the outsole 11, is a generally teardrop-shaped cavity 22, which also forms a bulge 23 which projects outwardly from the outer surface 12 of the outsole 11. Formed in the interior surface 15 and extending between the cavities 20 and 22 is an elongated, narrow restricted channel 24, which provides communication between the cavities 20 and 22. Preferably, the bulges 21 and 23 project only a slight distance outwardly of the outer surface 12, so that the outsole presents a relatively flat ground-contacting surface for stability.

Figure 9:
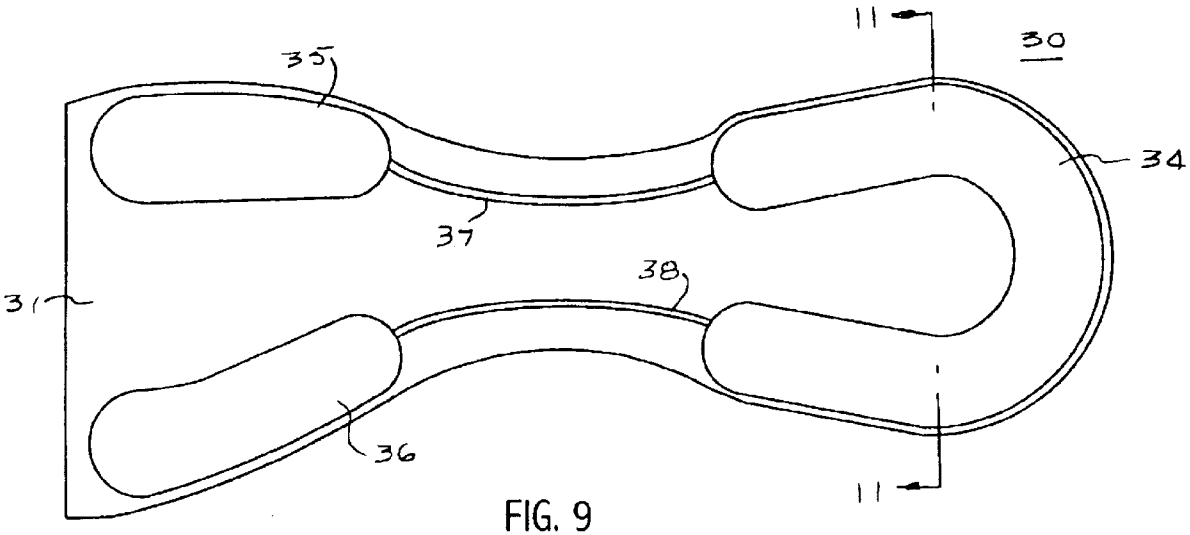
FIG. 9 is a top plan view of the bladder of FIG. 1.
Figure 10:
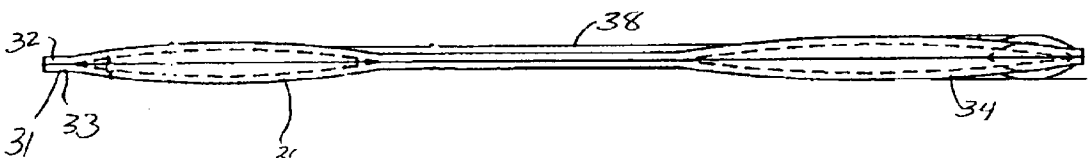
FIG. 10 is a side elevational view of the bladder of FIG. 9.
Figure 11:
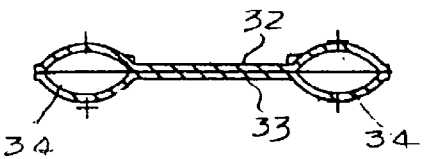
FIG. 11 is a sectional view taken generally along the line 11—11 in FIG. 9.

Referring now also to FIGS. 9–11, the bladder 30 includes a substantially flat base 31, which may be formed of two sheets 32 and 33 bonded together (see FIG. 10). The base 31 has an outline substantially matching that of the shallow recess 16 in the outsole 11. Formed in the bladder 30 is a generally horseshoe-shaped heel pocket 34 and two laterally spaced-apart metatarsal pockets 35 and 36. The base 31 defines a medial base plane at the junction of the sheets 32 and 33, and each of the pockets 34–36 projects substantially equidistantly upwardly and downwardly from that base plane, as can best be seen in FIG. 11. Also formed in the bladder 30 is an elongated, narrow, restricted passageway 37 which provides communication between the metatarsal pocket 35 and one end of the heel pocket 34. Also formed in the bladder 30 is another elongated, narrow, restricted passageway 38, which provides communication between the metatarsal pocket 36 and the other end of the horseshoe-shaped heel pocket 34. The pockets 34–36 are respectively positioned so that they will overlie the shallow recesses 17–19 in the outsole 11. The passageways 37 and 38 may also extend slightly above and below the base plane of the bladder 30, and they cooperate with the pockets 34–36 to form a closed fluid system which contains a suitable fluid, such as air.

Figure 7:
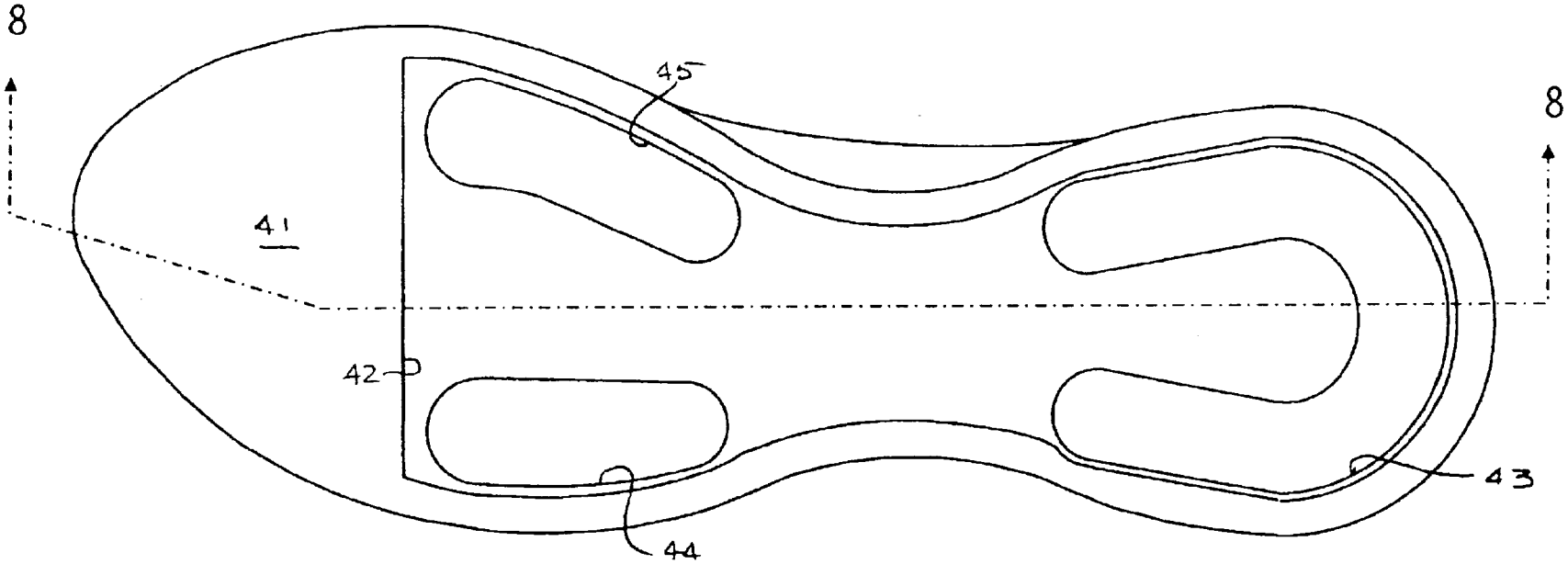
FIG. 7 is a bottom plan view of the midsole of FIG. 1.
Figure 8:
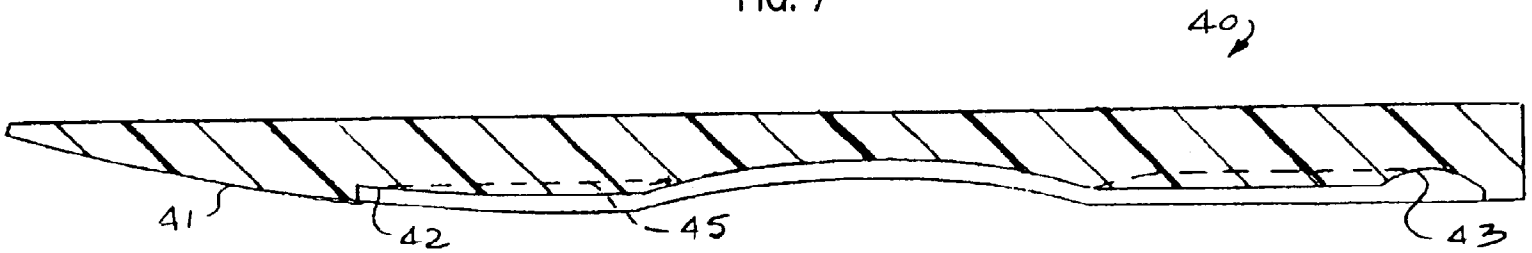
FIG. 8 is a sectional view taken generally along the line 8—8 in FIG. 7.

Referring also to FIGS. 7 and 8, the midsole 40 has a lower or outsole-facing surface 41, which may have formed therein a shallow recess 42 shaped substantially in the outline of the bladder 30 to facilitate positioning of the parts. Also formed in the outsole-facing surface 41, in a heel region of the midsole 40 is a generally horseshoe-shaped heel recess 43. Formed in the surface 41 in a metatarsal region of the midsole 40 are two laterally spaced-apart metatarsal recesses 44 and 45. The recesses 43–45 are, respectively, designed and positioned to accommodate the pockets 34–36 of the bladder 30.

In assembly, the bladder 30 is positioned on the interior surface 15 of the outsole 11, so that it will occupy the position outlined by the shallow recesses 16–19. It can be seen that, when thus positioned, the outsole cavity 20 is disposed between the legs of the bladder pocket 34, while the outsole cavity 22 is disposed between the metatarsal pockets 35 and 36 of the bladder 30. Thus, the bladder pockets are completely outside the outsole cavities. The midsole 40 is then positioned over the outsole 11 and the outsole-facing surface 41 is fixedly secured to the interior surface 15 of the outsole 11 by any suitable means, such as suitable bonding or the like. When thus bonded in place, the bladder pockets 34–36 will, respectively, be disposed in the midsole recesses 43–45 and the midsole 40 will cooperate with the outsole 11 to close the outsole cavities 20 and 22 and the restricted channel 24, trapping air therein. There results a footwear structure 10 having two separate closed fluid systems, viz., that formed by the bladder 30 and that formed by the now-closed cavities 20 and 22 and the restricted channel 24.

The outsole bulges 21 and 23 are slightly flexible and expansible to provide shock absorption while being worm. Also, during a walking movement, air is moved back and forth between the cavities 20 and 22 through the restricted channel 24, thereby providing a slight thrusting action, as is described in greater detail, e.g., in U.S. Pat. No. 5,416,986, the disclosure of which is incorporated herein by reference. The pockets 34–36 of the bladder 30 provide cushioning for the user's foot, while the passageways 37 and 38 also accommodate movement of air back and forth between the heel pocket 34 and the metatarsal pockets 35 and 36, this movement being accommodated by the flexible and resilient nature of the bladder 30, as is described, e.g., in U.S. Pat. No. 5,842,291, the disclosure of which is incorporated herein by reference. Also, the horseshoe shaped pocket 34 extending around the periphery of the heel region and the positions of the pockets 35 and 36 at opposite sides of the metatarsal region provide improved lateral stability in use.

From the foregoing, it can be seen that there has been provided an improved footwear structure which provides cushioning and fluid-assisted thrusting action while walking, in a design which incorporates two separate closed fluid systems.

The matter set forth in the foregoing description and accompanying drawings is offered by way of illustration only and not as a limitation. While a particular embodiment has been shown and described, it will be apparent to those skilled in the art that changes and modifications may be made without departing from the broader aspects of applicant's contribution. The actual scope of the protection sought is intended to be defined in the following claims when viewed in their proper perspective based on the prior art.

What is claimed is:

1. Footwear structure comprising:

an outsole having interior and exterior surfaces, the outsole having plural outwardly projecting bulges defining cavities opening at the interior surface and a restricted channel communicating with the cavities and opening at the interior surface, a midsole having an outsole-facing surface disposed against the interior surface of the outsole for closing the cavities and the restricted channel, and a flexible bladder disposed between the outsole and the midsole and having plural expandable fluid-containing pockets disposed outside the closed cavities and channel.

2. The footwear structure of claim 1, wherein the number of projecting bulges in the outsole is two.

3. The footwear structure of claim 2, wherein the projecting bulges include a heel bulge and a metatarsal bulge.

4. The footwear structure of claim 3, wherein the heel and metatarsal bulges are disposed substantially centrally of the lateral width of the outsole.

5. The footwear structure of claim 1, wherein the pockets in the bladder include heel and metatarsal pockets.

6. The footwear structure of claim 5, wherein the pockets in the bladder include one heel pocket and two metatarsal pockets.

7. The footwear structure of claim 6, wherein the heel pocket is generally horseshoe-shaped and the metatarsal pockets include two pockets respectively disposed adjacent to lateral edges of the bladder.

8. The footwear structure of claim 7, wherein the plural bulges in the outsole include a heel bulge disposed substantially centrally of the lateral width of the outsole and straddled by the horseshoe-shaped heel pocket, and a metatarsal bulge disposed substantially centrally of the lateral width of the midsole and between the metatarsal pockets of the bladder.

9. Footwear structure comprising:

an outsole having interior and exterior surfaces, the outsole having plural outwardly projecting bulges defining cavities opening at the interior surface and a restricted channel communicating with the cavities and opening at the interior surface, a flexible bladder having plural expandable pockets and a restricted passageway providing fluid communication between the pockets and cooperating therewith to form a first closed fluid-containing system, the bladder being disposed on the interior surface of the outsole with the pockets disposed outside the cavities, and a midsole have an outsole-facing surface disposed against the interior surface of the outsole for closing the cavities and the restricted channel of the outsole to form a second closed fluid-containing system out of communication with the first closed fluid-containing system, the midsole having recesses therein respectively receiving the pockets of the bladder.

10. The footwear structure of claim 9, wherein the number of projecting bulges in the outsole is two.

11. The footwear structure of claim 10, wherein the projecting bulges include a heel bulge and a metatarsal bulge.

12. The footwear structure of claim 9, wherein the pockets in the bladder include heel and metatarsal pockets.

13. The footwear structure of claim 12, wherein the bladder pockets include a generally horseshoe-shaped heel pocket and two metatarsal pockets respectively disposed adjacent to lateral side edges of the bladder.

14. The footwear structure of claim 13, wherein the bladder includes a first restricted channel providing communication between one end of the heel pocket and one of the metatarsal pockets, and a second restricted passageway providing communication between the other end of the heel pocket and the other metatarsal pocket.

15. The footwear structure of claim 9, wherein the bladder includes a substantially flat base defining a base plane, each of the pockets extending upwardly and downwardly from the base plane.

16. A method of forming footwear structure including an outsole and a midsole comprising:

providing in the outsole plural outwardly projecting bulges defining cavities and a restricted channel communicating with the cavities, the cavities and channel opening at an interior surface of the outsole, disposing on the interior surface of the outsole a flexible bladder with plural expandable fluid-containing pockets to form a first closed fluid-containing system, so that the pockets are disposed outside the cavities, and attaching the midsole to the interior surface of the outsole so that it closes the cavities and the restricted channel to form a second closed fluid-containing system out of communication with the first closed fluid-containing system and cooperates with the outsole to trap the bladder therebetween.

17. The method of claim 16, wherein the providing step includes providing heel and metatarsal bulges in the outsole.

18. The method of claim 16, wherein the disposing step includes disposing a bladder including a generally horseshoe-shaped heel pocket and two laterally spaced-apart metatarsal pockets.

19. The method of claim 18, wherein the disposing step includes disposing a flexible bladder which includes a first restricted passageway providing communication between one end of the heel pocket and one of the metatarsal pockets, and a second restricted passageway providing communication between the other end of the heel pocket and the other metatarsal pocket.

20. The method of claim 16, and further comprising providing recesses in the midsole respectively to receive the pockets of the bladder.

* * * * *